United States Patent [19]

Petroff

[11] Patent Number: 4,784,799

[45] Date of Patent: Nov. 15, 1988

[54] SYNERGISTIC SURFACTANT COMPOSITIONS

[75] Inventor: Lenin J. Petroff, Midland, Mich.

[73] Assignee: Dow Corning Corporation, Midland, Mich.

[21] Appl. No.: 149,241

[22] Filed: Jan. 25, 1988

[51] Int. Cl.[4] ..... C11D 1/92; C11D 1/94

[52] U.S. Cl. ..... 252/545; 252/174.15; 252/547; 252/554; 252/558; 252/DIG. 14

[58] Field of Search ..... 252/554, 547, 357, 309, 252/174.15, 558, 545

[56] References Cited

U.S. PATENT DOCUMENTS 3,562,786 2/1971 Bailey et al. ..... 252/137

*Primary Examiner*—Paul Lieberman
*Assistant Examiner*—Kathleen Markowski
*Attorney, Agent, or Firm*—Jim L. De Cesare

[57] ABSTRACT

A synergistic surfactant composition comprising an alkylbenzenesulfonate anionic surfactant and at least one organic zwitterionic functional silicone zwitterionic surfactant represented by the formula:

$$Me_3SiO[SiMe_2O]_x[SiMeR^1O]_ySiMe_3$$

and wherein:

$R^1 = CH_2CH_2CH_2N(R^2)_2(CH_2)_zSO_3^-$ $R^2$ = methyl or ethyl x = 0–3

Y = 1–2, and z = 3–4.

The particular zwitterionic surfactants are represented by the following formulas:

$$(Me_3SiO)_2Si(Me)(CH_2)_3NMe_2(CH_2)_3SO_3^- \text{ and}$$

$$Me_3SiO(\overset{\overset{Me}{|}}{\underset{\underset{(CH_2)_3NMe_2(CH_2)_3SO_3^-}{|}}{Si}}O)_2SiMe_3$$

9 Claims, 2 Drawing Sheets

SYNERGISTIC SURFACTANT COMPOSITIONS

BACKGROUND OF THE INVENTION

This invention relates to a synergistic surfactant composition formed by combining an alkylbenzenesulfonate anionic surfactant with at least one organic zwitterionic functional silicone zwitterionic surfactant represented by the formula:

$$Me_3SiO[SiMe_2O]_x[SiMeR^1O]_ySiMe_3$$

and wherein:

Me=methyl;

$R^1=CH_2CH_2CH_2N^+(R^2)_2(CH_2)_zSO_3^-$;

$R^2$=methyl or ethyl;

x=0–3;

y=1–2; and z=3–4.

More particularly, the zwitterionic surfactants are represented by the following formulas:

$$(Me_3SiO)_2Si(Me)(CH_2)_3NMe_2(CH_2)_3SO_3^- \text{ and}$$

$$Me_3SiO(\overset{\overset{Me}{|}}{\underset{\underset{(CH_2)_3NMe_2(CH_2)_3SO_3^-}{|}}{Si}}O)_2SiMe_3$$

A surfactant is a compound that reduces surface tension when dissolved in a liquid decreasing the attractive force exerted by molecules below the surface of the liquid upon those molecules at the surface of the liquid enabling the liquid to flow more readily. Liquids with low surface tensions flow more readily than water, while mercury with the highest surface tension of any liquid does not flow but disintegrates into droplets.

Surfactants exhibit combinations of cleaning, detergency, foaming, wetting, emulsifying, solubilizing, and dispersing properties. They are classified depending upon the charge of the surface active moiety, usually the larger part of the molecule. In anionic surfactants, the moiety carries a negative charge as in soap. In cationic surfactants, the charge is positive. In non-ionic surfactants, there is no charge on the molecule, and in amphoteric surfactants, solubilization is provided by the presence of positive and negative charges in the molecule.

Zwitterionic surfactants of the type disclosed herein are generally considered specialty surfactants. They do not irritate skin and eyes, and exhibit good surfactant properties over a wide pH range. This category of surfactant is compatible with anionic, cationic, and non-ionic surfactants, and the use of these amphoteric surfactants ranges from detergents, emulsifiers, wetting and hair conditioning agents, foaming agents, fabric softeners, to anti-static agents. In cosmetic formulations, certain specialized zwitterionic surfactants reduce eye irritation caused by sulfate and sulfonate surfactants present in such products.

In U.S. Pat. No. 3,562,786, issued Feb. 9, 1971, to Bailey et al, there is disclosed the broad concept of blending organic surfactants with silicone-glycol type surfactants in order to achieve a synergy. The surfactants in Bailey et al, however, are generally considered to be of the standard non-ionic silicone type, rather than amphoteric, as in the present invention. Thus, in contrast to Bailey et al, the present invention blends organic surfactants with a new class of silicone sulfobetaine zwitterionic surfactants in order to achieve a synergistic effect. The sulfobetaine surfactants of the present invention, because they are a new class of silicone surfactant, possess advantages not inherent in Bailey et al. For example, one would not expect a zwitterionic surfactant to perform in the same fashion as a non-ionic surfactant as in Bailey et al because of the differences in the charged natures of the two categories of surfactants. Further, the zwitterionic surfactants of the present invention are solids and have a low water solubility in comparison to the Bailey et al liquid surfactants which are very water soluble. In addition, the zwitterionic surfactants of the present invention possess much lower critical micelle concentrations than the non-ionic surfactants in Bailey et al.

Such disadvantages of the prior art are overcome with the present invention wherein not only is a new class of silicone surfactant disclosed but a surfactant that possesses synergistic properties when combined with organic surfactants.

SUMMARY OF THE INVENTION

This invention relates to a synergistic surfactant composition comprising an alkylbenzenesulfonate anionic surfactant and at least one zwitterionic organofunctional siloxane zwitterionic surfactant.

This invention also relates to a synergistic surfactant compositions comprising a linear alkylate sulfonate anionic surfactant and at least one silicone sulfobetaine zwitterionic surfactant.

This invention further relates to a synergistic surfactant composition comprising an alkylbenzenesulfonate anionic surfactant and at least one organic zwitterionic functional silicone-zwitterionic surfactant represented by the formula:

$$Me_3SiO[SiMe_2O]_x[SiMeR^1O]_ySiMe_3$$

and wherein:

Me=methyl;

$R^1=CH_2CH_2CH_2N(R^2)_2(CH_2)_zSO_3^-$;

$R_2$=methyl or ethyl;

x=0–3;

y=1–2; and z=3–4.

This invention still further relates to a synergistic surfactant composition comprising sodium dodecylbenzenesulfonate anionic surfactant and at least one organic zwitterionic functional silicone zwitterionic surfactant represented by the formula:

$$Me_3SiO[SiMe_2O]_x[SiMeR^1O]_ySiMe_3$$

and wherein:

Me=methyl;

$R^1=CH_2CH_2CH_2N(R^2)_2(CH_2)_zSO_3^{-1}$;

$R^2$=methyl or ethyl;

x=0–3;

y=1–2; and z=3–4.

The zwitterionic surfactant is a compound having the formula:

$$(Me_3SiO)_2Si(Me)(CH_2)_3NMe_2(CH_2)_3SO_3^-$$

or

-continued

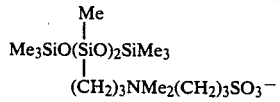

It is therefore an object of the present invention to provide a synergistic surfactant composition comprising an alkylbenzenesulfonate anionic surfactant and at least one organic zwitterionic functional silicone zwitterionic surfactant represented by the formula:

$$Me_3SiO[SiMe_2O]_x[SiMeR^1O]_ySiMe_3$$

and wherein:

Me=methyl;

$R^1=CH_2CH_2CH_2N(R^2)_2(CH_2)_zSO_3^-$;

$R^2$=methyl or ethyl;

x=0–3;

y=1–2; and z=3–4 and wherein the zwitterionic surfactants are represented by the following formulas:

$$(Me_3SiO)_2Si(Me)(CH_2)_3NMe_2(CH_2)_3SO_3^- \quad (1)$$

and

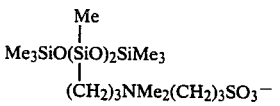

(2)

It is another object of the present invention to provide a method of reducing the surface tension of an aqueous solution by adding to the aqueous solution an effective amount of a synergistic surfactant composition comprising sodium dodecylbenzenesulfonate anionic surfactant and at least one organic zwitterionic functional silicone zwitterionic surfactant represented by the formula:

$$Me_3SiO[SiMe_2O]_x[SiMeR^1O]_ySiMe_3$$

and wherein:

Me=methyl;

$R^1=CH_2CH_2CH_2N(R^2)_2(CH_2)_zSO_3^{-1}$;

$R^2$=methyl or ethyl;

x=0–3;

y=1–2; and z=3–4 whereby the surface tension of the aqueous solution is lower than if either of the anionic surfactant and the zwitterionic surfactant were present in the aqueous solution individually.

These and other features, objects, and advantages of the present invention will become apparent from the following detailed description wherein reference is made to the several figures in the accompanying drawings.

DETAILED DESCRIPTION OF THE INVENTION

In the present invention, silicone sulfobetaine surfactants have been found to behave synergistically in terms of surface tension reduction when used in combination with an alkylbenzenesulfonate such as sodium dodecylbenzenesulfonate. It has been determined experimentally, that the surface tension of an aqueous solution containing a silicone sulfobetaine surfactant together with the alkylbenzenesulfonate is lower than if the aqueous solution contained only one of the ingredients individually. Data were obtained relating to both the equilibrium surface tension as well as the dynamic surface tension. A DuNouy ring tensiometer was used to generate equilibrium surface tension data, whereas the dynamic surface tension data were obtained by a procedure which is a refinement of the standard maximum bubble pressure method with the aid of a SensaDyne 5000 surface tensiometer manufactured by CHEMDYNE Research Corporation, Madison, Wis.

The experimental data has been set forth graphically in the form of FIGS. 1–4 as seen in the accompanying drawings in order to better facilitate an understanding of the present invention. It should be noted that FIGS. 1, 3, and 4, pertain to the zwitterionic surfactant represented by Formula 1, whereas FIG. 2 pertains to the zwitterionic surfactant represented by Formula 2. Further, FIGS. 1 and 2 portray equilibrium surface tension data, whereas FIGS. 3 and 4 portray dynamic surface tension data.

Figure 1:
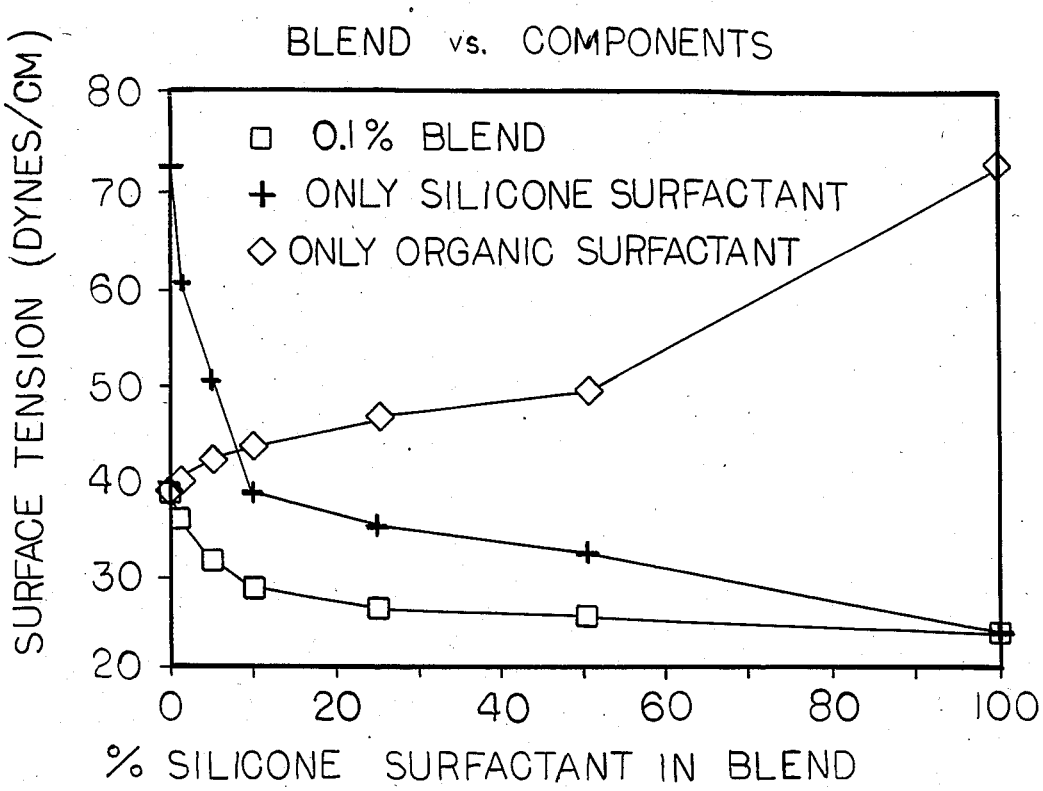
FIG. 1 is a graphical representation illustrating the effects on equilibrium surface tension of combining one of the zwitterionic surfactants of the present invention with an anionic surfactant.

Specifically, FIG. 1 shows the effects of blending the surfactant represented by Formula 1 with linear sodium dodecylbenzenesulfonate. This figure depicts the relationship between equilibrium surface tension and a series of blends of the Formula 1 surfactant with the sulfonate surfactant. The blends range from pure sodium dodecylbenzenesulfonate anionic surfactant to pure zwitterionic surfactant represented by Formula 1. As noted above, the equilibrium surface tension data were generated by employing a DuNouy ring tensiometer in accordance with the method described in ASTM D1331-54-T.

The surface tension data for the various blends were obtained by utilizing solutions containing 0.1% of the blend of the anionic and zwitterionic surfactants. Hence, a 0.0% silicone sample was in actuality a 0.1% solution of the anionic surfactant. A 50% silicone sample contained 0.05% of the zwitterionic surfactant and 0.05% of the anionic surfactant. The 100% silicone sample was equivalent to 0.1% zwitterionic surfactant. FIG. 1 therefore shows the relationship that exists between the surface tension versus the percentage of silicone in the blend. The figure in addition illustrates what the surface tension would be in the event that only the individual surfactants were present at the effective concentrations of the blend.

An examination of FIG. 1 reveals that a synergistic effect is achieved by blending the linear sodium dodecylbenzenesulfonate anionic surfactant with the silicone sulfobetaine zwitterionic surfactant represented by Formula 1. It should be noted that throughout the range, the surface tension of the blend is lower than the surface tension exhibited by either of the two components individually. For example, the surface tension of a 0.1% solution of a 10/90 blend of the two surfactants can be seen to be 28.34 dynes/cm. The effective concentration of silicone sulfobetaine zwitterionic surfactant in such blend (0.01%) yields a surface tension value of 38.73 dynes/cm. Similarly, the effective concentration of the anionic surfactant (0.09%) provides a surface tension value of 43 dynes/cm. A synergy of 10.39 dyne/cm was therefore achieved by employing a blending of each of the two materials rather than using them individually. The synergistic effect, it should be noted, begins to diminish in the event that the blend of the anionic surfactant and the zwitterionic surfactant contains less than about 5% and more than about 15% silicone sulfobetaine zwitterionic surfactant.

Figure 2:
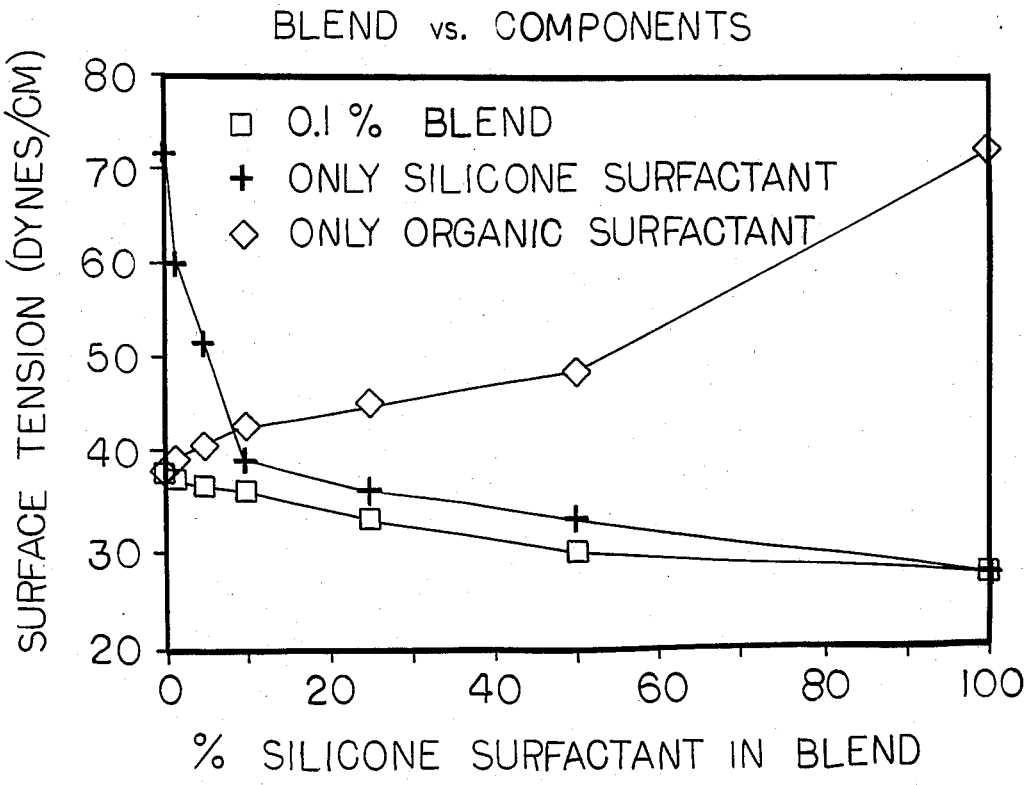
FIG. 2 is another graphical representation illustrating the effects on equilibrium surface tension of combining another of the zwitterionic surfactants of the present invention with an anionic surfactant.

FIG. 2 is similar to FIG. 1 except that the zwitterionic surfactant represented by Formula 2 was employed, otherwise the procedures noted above with respect to FIG. 1 are the same in FIG. 2. In FIG. 2, the synergistic effect is not as pronounced as is illustrated in FIG. 1, yet the synergistic effect in FIG. 2 is still apparent. Thus, a 0.1% solution of a 5/95 blend of the anionic surfactant with the zwitterionic surfactant represented by Formula 2 yielded a surface tension of 37.64 dynes/cm. By way of comparison, the effective concentration employing the zwitterionic surfactant alone yielded a surface tension of about 52 dynes/cm, whereas the effective concentration utilizing only the anionic surfactant provided a surface tension of 41.5 dynes/cm. Thus, there can be seen a synergistic effect in the amount of 3.86 dynes/cm.

Figure 3:
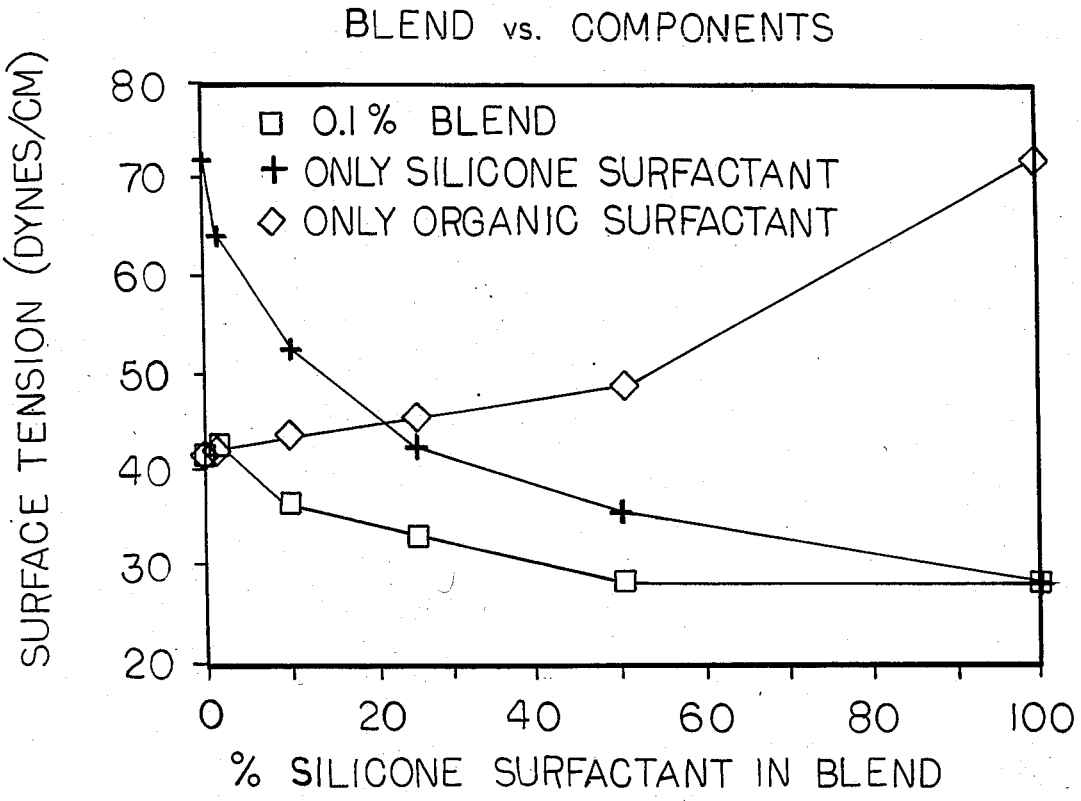
FIG. 3 is a graphical representation illustrating the effects on dynamic surface tension of combining the zwitterionic surfactant of FIG. 1 with an anionic surfactant at a slow bubble evolution.
Figure 4:
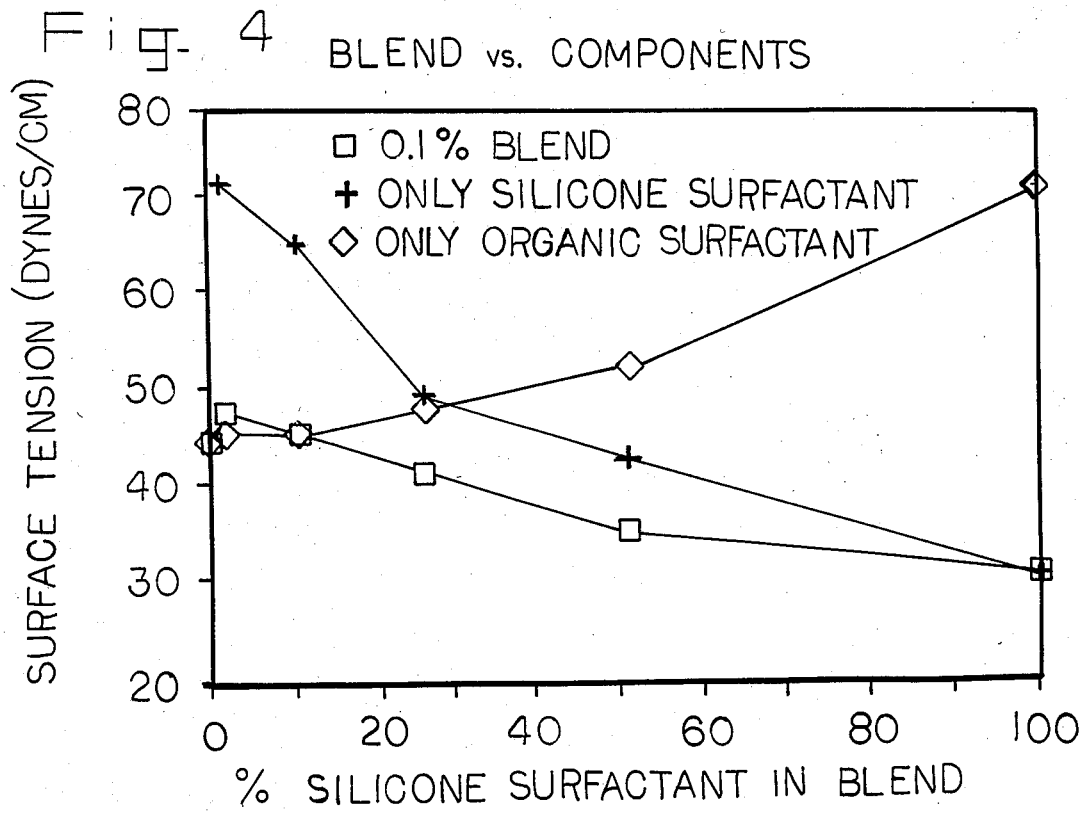
FIG. 4 is a graphical representation illustrating the effects on dynamic surface tension of combining the zwitterionic surfactant of FIG. 1 with an anionic surfactant at a fast bubble evolution.

With reference to FIGS. 3 and 4, there is illustrated therein the response of the surfactants of the present invention to dynamic surface tension measurements. Dynamic surface tension is a second measure of surface activity, and measures the surface energy of the test fluid and the speed of surfactant migration. As noted above, dynamic surface tension is measured utilizing the maximum bubble pressure method with a SensaDyne 5000 surface tensiometer. This instrument measures surface tension by determining the force required to blow bubbles from an orifice and into the test solution. Thus, a low surface energy fluid requires less energy to force a bubble out of the orifice than does a fluid of high surface energy. The speed of surfactant migration, however, is determined by changing the speed of the evolution of the bubbles. With a slow bubble rate, the surfactants have more time to reach the bubble-liquid interface and to orient in order to reduce the surface energy at the interface. With a fast bubble rate, the surfactants have less time to reach the newly formed bubble before the bubble is forced from the orifice. Hence, the surface energy for the fast rate is higher than the surface energy for the slow rate. In the instrument itself, a process gas such as dry nitrogen or clean dry air, is bubbled through two tubes of different diameter that are immersed in the fluid being tested. At each orifice, a bubble is formed in a controlled manner until the bubble reaches a maximum value where it breaks off rising to the surface of the test fluid. Since the two orifices differ in diameter, the two bubbles differ in maximum size and in the maximum pressure required to expand each bubble. This differential pressure is sensed by a transducer and the resulting output signal is used to measure dynamic surface tension directly.

The foregoing technique was used in order to determine the dynamic surface tension of blends of the zwitterionic surfactant represented by Formula 1 and the anionic surfactant sodium dodecylbenzenesulfonate, and the results are graphically represented in FIGS. 3 and 4. Blends were prepared of the anionic and the zwitterionic surfactants ranging from 100% of sodium dodecylbenzenesulfonate to 100% of the silicone sulfobetaine surfactant represented by Formula 1. The various blends were tested at concentrations of 0.1%. Evaluations of the blends was made on the SensaDyne 5000 tensiometer, with such evaluations being conducted at a low bubble speed and at a high bubble speed. Data from the tests was then plotted graphically and represented as FIGS. 3 and 4 in order to show the synergistic effects of employing both materials in comparison to using either individually.

Specifically, in FIG. 3 there will be seen the relationship between surface tension and percentage of silicone in the blend, and at a slow bubble evolution rate. The concentation of the blends evaluated was 0.1%, and the surface tension of the various blends was compared to the surface tension of the individual components at the effective concentration of the blend. FIG. 3 clearly reveals that the combination of the two surfactants is far superior to either of the surfactants when employed individually. Thus, the surface tension of the blend is lower than the surface tension of the individual components at any blend ratio. FIG. 4 covers the same concept as FIG. 3 except that in FIG. 4 the surface tension was measured at a fast bubble rate of evolution. The effect of the fast bubble rate in FIG. 4 in comparison to the slow bubble rate in FIG. 3 is that the surface tension values in FIG. 4 are higher than the surface tension values computed for FIG. 3. However, even at the fast bubble rate in FIG. 4, the synergistic effect is still apparent at blend ratios greater than 10/90. Therefore, the foregoing data is represented by FIGS. 1–4 clearly shows that blends of silicone sulfobetaines with linear dodecylbenzenesulfonates exhibit properties superior than if either material was used individually. The synergistic effect is also apparent for both the equilibrium surface tension as well as the dynamic surface tension measured.

The compounds of the present invention, more particularly the zwitterionic organofunctional siloxanes represented by Formulas 1 and 2, for example, are prepared by the quaternization of precursor aminofunctional siloxanes with either cyclic propane sultone or cyclic butane sultone. Specifically, these silicone sulfobetaines are prepared by a two-step process as set forth below:

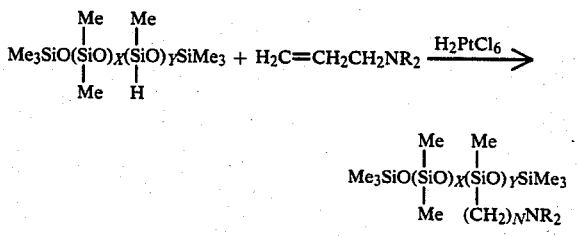

-continued

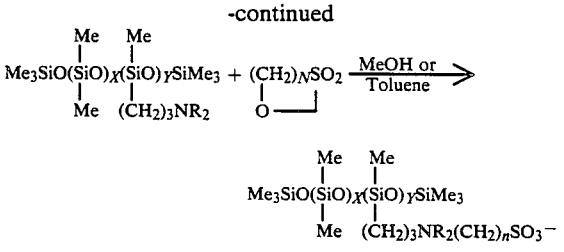

where

Me=methyl;

x=0–3;

y=1, 2;

R=methyl or ethyl; and n=3, 4.

These types of compounds are colorless solids and are non-toxic and useful as organic surfactant enhancers. They have been found to be particularly useful in order to enhance detergent surfactants, in liquid detergents, cleaners, automatic dishwashing detergents, and in powdered detergents for washing machines. Details of the synthesis of these materials are set forth in a copending U.S. patent application Ser. No. 07-004,734, of William N. Fenton et al, filed Jan. 20, 1987, and assigned to the same assignee as the present case, and reference may be had thereto.

It will be apparent from the foregoing that many other variations and modifications may be made in the structures, compounds, compositions, and methods described herein without departing substantially from the essential concepts of the present invention. Accordingly, it should be clearly understood that the forms of the invention described herein and depicted in the accompanying drawings are exemplary only and are not intended as limitations on the scope of the present invention.

That which is claimed is:

1. A synergistic surfactant composition comprising sodium dodecylbenzenesulfonate anionic surfactant and at least one organic zwitterionic functional silicone surfactant represented by the formula:

$$Me_3SiO[SiMe_2O]_x[SiMeR^1O]_ySiMe_3$$

and wherein:

Me=methyl;

$R^1=CH_2CH_2CH_2N^+(R^2)_2(CH_2)_zSO_3^-$;

$R^2$=methyl or ethyl;

x=0–3;

y=1–2; and z=3–4.

2. A synergistic surfactant composition comprising an alkylbenzenesulfonate anionic surfactant and at least one organic zwitterionic functional silicone surfactant represented by the formula:

$$Me_3SiO[SiMe_2O]_x[SiMeR^1O]_ySiMe_3$$

and wherein:

Me=methyl;

$R^1=CH_2CH_2CH_2N^+(R^2)_2(CH_2)_zSO_3^-$;

$R^2$=methyl or ethyl;

x=0–3;

y=1–2; and z=3–4.

3. A synergistic surfactant composition as claimed in claim 1 or 2 wherein the zwitterionic surfactant is a compound having the formula:

$$(Me_3SiO)_2Si(Me)(CH_2)_3N^+Me_2(CH_2)_3SO_3^-$$

4. A synergistic surfactant composition as claimed in claim 1 or 2 wherein the zwitterionic surfactant is a compound having the formula:

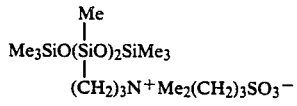

5. The method of reducing the surface tension of an aqueous solution comprising adding to the aqueous solution an effective amount of a synergistic surfactant composition comprising an organic anionic surfactant and at least one organic zwitterionic functional silicone surfactant represented by the formula:

$$Me_3SiO[SiMe_2O]_x[SiMeR^1O]_ySiMe_3$$

and wherein:

Me=methyl;

$R^1=CH_2CH_2CH_2N(R^2)_2(CH_2)_zSO_3^-$;

$R^2$=methyl or ethyl;

x=0–3;

y=1–2; and z=3–4 whereby the surface tension of the aqueous solution is lower than if either of the anionic surfactant and the zwitterionic surfactant were present in the aqueous solution individually.

6. The method of reducing the surface tension of an aqueous solution comprising adding to the aqueous solution an effective amount of a synergistic surfactant composition comprising an alkylbenzenesulfonate anionic surfactant and at least one organic zwitterionic functional silicone surfactant represented by the formula:

$$Me_3SiO[SiMe_2O]_x[SiMeR^1O]_ySiMe_3$$

and wherein:

Me=methyl;

$R^1=CH_2CH_2CH_2N(R^2)_2(CH_2)_zSO_3^-$;

$R^2$=methyl or ethyl;

x=0–3;

y=1–2; and z=3–4 whereby the surface tension of the aqueous solution is lower than if either of the anionic surfactant and the zwitterionic surfactant were present in the aqueous solution individually.

7. The method as claimed in one of claims 5–6 wherein the zwitterionic surfactant is a compound having the formula $$(Me_3SiO)_2Si(Me)(CH_2)_3N^+Me_2(CH_2)_3SO_3^{-1}.$$

8. The method as claimed in one of claims 5–6 wherein the zwitterionic surfactant is a compound having the formula

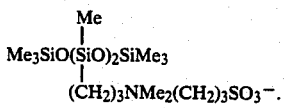
9. A synergistic surfactant composition comprising an organic surfactant and at least one organic zwitterionic functional silicone surfactant represented by the formula:
and wherein:
Me=methyl;
$R^1=CH_2CH_2CH_2N(R^2)_2(CH_2)_zSO_3^-$;
$R^2$=methyl or ethyl;
x=0–3;
y=1–2; and
z=3–4.
* * * * *